US005080607A

United States Patent [19]

Cristescu

[11] Patent Number: 5,080,607

[45] Date of Patent: Jan. 14, 1992

[54] SUPPORT MEMBER FOR A DESIGNATION LABEL FOR TERMINALS OF A CROSS-CONNECT CONNECTOR

[75] Inventor: Alex G. Cristescu, Biossaid, Canada

[73] Assignee: Northern Telecom Limited, Montreal, Canada

[21] Appl. No.: 527,808

[22] Filed: May 24, 1990

[51] Int. Cl.[5] ..... H01R 3/00

[52] U.S. Cl. ..... 439/491; 439/586

[58] Field of Search ..... 439/488–491, 439/718, 738, 750, 910

[56] References Cited

U.S. PATENT DOCUMENTS 3,753,216 8/1973 Johnson et al. ..... 439/491
3,945,706 3/1976 Steiner et al. ..... 439/491
4,180,305 12/1979 Ustin et al. ..... 439/718
4,752,248 6/1988 Rudy, Jr. et al. ..... 439/718

FOREIGN PATENT DOCUMENTS 8204367 6/1984 Netherlands ..... 439/491

*Primary Examiner*—David L. Pirlot
*Attorney, Agent, or Firm*—R. J. Austin

[57] ABSTRACT

An elongate support member for a designation label for a cross-connect connector and having on one side a resilient retainer for attaching the support member to the connector. A manually operable release is provided for removing the support member and the support member also has a side with an elongate surface for receiving the designation label.

13 Claims, 2 Drawing Sheets

SUPPORT MEMBER FOR A DESIGNATION LABEL FOR TERMINALS OF A CROSS-CONNECT CONNECTOR

This invention relates to support members for designation labels for terminals of cross-connect connectors.

In a telecommunications system, an incoming cable to a customer's premises is connected to a distribution cable for distribution of the electrical wiring to access points and terminals within the premises. The distribution cable may be connected to a further cable or to in-series or in-parallel cables. At each connection location between cables it is common to use a distribution frame which detachably carries connectors for electrically connecting the conductor wires of one cable with those of another or other cables. The distribution frame may be of the construction described in U.S. Pat. No. 4,278,315.

The connectors are normally of a construction referred to as cross-connect connectors, in that each connector comprises a dielectric body with two spaced rows of terminals held by the body, and the two rows of terminals are electrically interconnected in the desired manner through the dielectric body. The cross-connect connectors may be of the construction described in U.S. Pat. No. 4,295,703.

The incoming cable is brought to an input location on the distribution frame and its individual wires are distributed to various positions for mounting into one set of terminals of cross-connect connectors as required. Wires to end use equipment, such as telephones or data processing equipment are connected from the other set of terminals of the cross-connect connectors.

The distribution frame may have latches for detachably mounting cross-connect connectors in parallel one above the other, with ends of each connector received in a mounting position comprising a pair of latches in the frame. Latches may be arranged to mount the connectors in pairs, one above the other with space between the connectors of each pair for a support member for a designation label, which also snaps into latches on the distribution frame. Each frame has space, for example, for five pairs of connectors with a snap-in support member for a designation label between the connectors of each pair.

The snap-in support member for a designation label occupies a region between mounting positions for cross-connect connectors which could otherwise be used to accommodate electronic components such as terminating resistors or modular jacks on the distribution frame.

For example, wiring within a distribution frame may be simplified by using cross connectors each having a body with an extension having integral modular jacks which are pre-wired to terminals on the associated cross-connect connector, allowing equipment to be detachably and interchangeably connected to the modular jacks by modular plugs of the industry standard, telecommunications type. A connector of this type is described in U.S. Pat. No. 4,797,124, and occupies two mounting positions in the distribution frame described in U.S. Pat. No. 4,278,315.

The present invention seeks to provide a support member for a designation label for terminals of a cross-connect connector which overcomes the above problems in use.

According to one aspect of the invention there is provided a support member for a designation label for terminals of a cross-connect connector comprising: an elongate body having resiliently releasable retaining means extending from one side of the body for retaining the body in attachment with the cross-connect connector, and manually operable release means for releasing the retaining means for removal and installation of the support member; and the body providing on another side an elongate surface for receiving a designation label.

The support member of the invention provides a surface for receiving a designation label for a cross-connect connector which is thus attachable to a row of terminals of the connector. The resilient retaining means together with the release means enables the support member to be attached and detached easily. Thus a separate support member for receiving a designation label which takes up space in a distribution frame between cross-connect connectors is not required.

According to another aspect of the invention there is provided a support member for designation labels for terminals of a cross-connect connector comprising an elongate body having on one side laterally extending elongate sidewalls, said one side of the body and the sidewalls defining an elongated recess for receiving a row of terminals of a cross-connect connector, and the sidewalls being resiliently movable away from one another and providing means for retaining the body in attachment with the cross-connect connector, and manually operable release means for moving the sidewalls away from one another for releasing the retaining means for removal and installation of the support member for designation labels; and the body providing on another side an elongate surface for receiving a designation label.

Preferably, the retaining means comprises latch projections on opposing sidewalls, and the manually operable release means comprises at least one latch operating extension of the body, on a side remote from the recess, the at least one latch operating extension being operable to cause the latch projections to move resiliently apart from one another.

In a preferred construction, the support member for designation labels is extrusion moulded from a resiliently deformable plastic material. Support members for designation labels of this construction are economical to manufacture as a continuous strip moulding which may be cut into desired lengths.

According to a further aspect of the invention there is provided an assembly of a support member for a designation label for terminals of a cross-connect connector and a cross-connect connector, the assembly comprising: a support member having an elongate body providing resiliently releasable retaining means extending from one side of the body and retaining the body over a row of terminals of the cross-connect connector; manually operable means for releasing the retaining means from the connector for removal and installation of the support member; and the support member providing on another side of the body, facing away from the connector, an elongate surface for receiving a designation label for the connector.

Thus in use of a support member for a designation label in an assembly with a cross-connect connector, a surface for a designation label is provided which is attachable to the connector itself, and the space between the connectors is available for other electrical components.

The elongate surface faces away from the connector so that the label is readily visible when a connector is installed in a distribution frame. The elongate surface may be provided with a label retaining flange for positioning a label to be adhesively affixed to the surface.

A support member for a designation label according to the invention may be easily installed on and removed from a connector without special tools.

A further advantage of an assembly according to the invention is that in use, the support member for designation labels may provide strain relief for wire conductors received in the insulation displacement terminals of the cross-connect connector, retaining the wires firmly in place, with the latches which act to retain the support member for designation labels on the connector also acting to hold wire conductors in the terminals. Furthermore, in cases where cross-connect connectors have sharp teeth-like projections along the row of insulation displacement terminals, the support member provides finger protection against the projections of the body of the cross-connect connector. The support member may also prevent accidental removal or dislodging of wire conductors from terminals during installation or maintenance work on neighbouring connectors in the distribution frame.

Embodiments of the invention will now be described by way of example, with reference to the accompanying drawings, in which.

Figure 1:
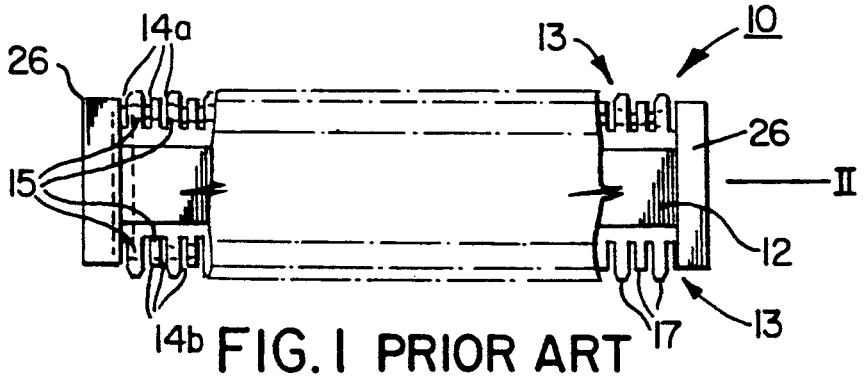
FIG. 1 PRIOR ART
FIG. 1 is a side view of a cross-connect connector of the prior art.
Figure 2:
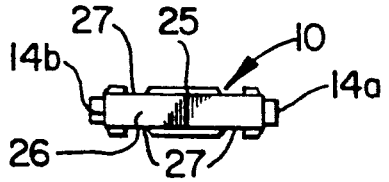
FIG. 2 PRIOR ART
FIG. 2 is an end view in the direction of arrow II in FIG. 1 of a connector of the prior art.

As shown in FIGS. 1 and 2, a cross-connect connector 10, such as that described in U.S. Pat. No. 4,295,703, to B. T. Osborne entitled "Connector Block" and issued Oct. 20, 1981, comprises a substantially planar body 12 of dielectric material having along each edge 13 a row of terminals 14*a* and 14*b*. Each terminal of one row 14*a* is electrically connected through the connector body 12 to a terminal in the other row 14*b*. A row of slots 15 is formed in each edge 13 of the connector body 12. The terminals are of the type known as insulation displacement terminals, and an opposing conductor portion of each terminal is arranged on each side of a slot within the body. Each edge 13 of the body 12 forms a row of sharp teeth-like projections 17 extending between terminal slots 15. The connector body 12 has moulded grooves 27 extending lengthwise of the body along the planar sides 25, beside each row of terminals 14*a* and 14*b* and between ends 26 of the connector.

Figure 3:
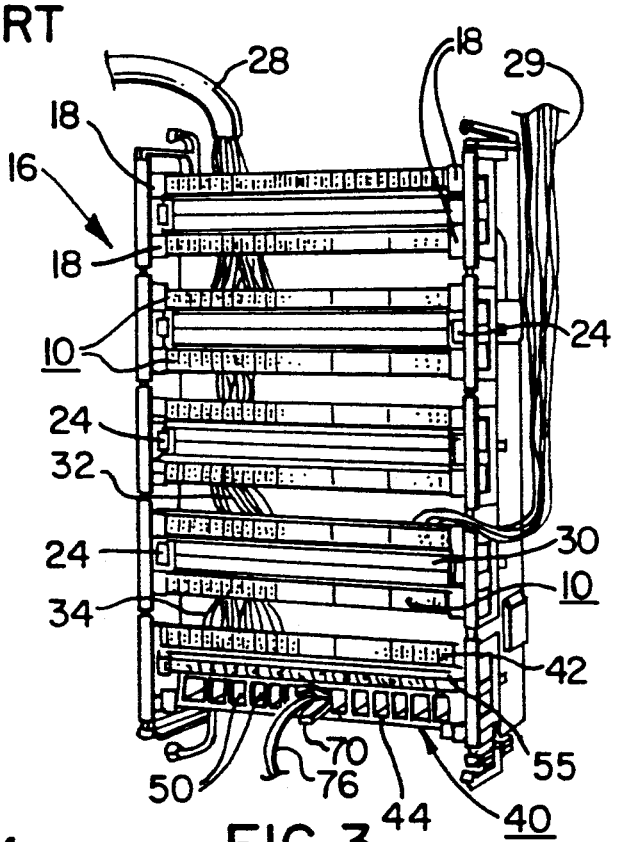
FIG. 3 PRIOR ART
FIG. 3 is an isometric view showing cross-connect patch connectors and designation strips mounted in a distribution frame of the prior art.
Figure 4:
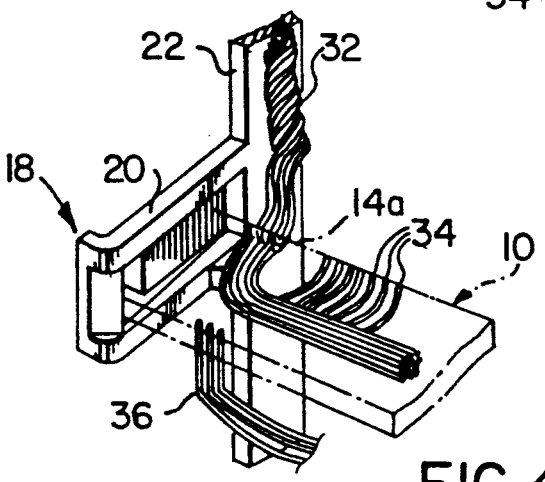
FIG. 4 PRIOR ART
FIG. 4 is an isometric view, on a larger scale, of part of the assembly of FIG. 3, to show the mounting means.

The cross-connect connector shown in FIG. 1 is normally used in a prior art distribution frame arrangement and wiring assembly, an example of which is shown in FIG. 3. A distribution frame and wiring assembly comprises a frame 16 having a plurality of mounting means for detachably holding a plurality of cross-connect connectors 10 in predetermined mounting positions. A typical frame 16 has ten mounting means, each of which comprises a pair of horizontally aligned and spaced parts 18. Each part 18 comprises a resilient horizontal latch 20 standing forwardly from an integral support 22 (FIG. 3). Each end 26 of a cross-connect connector is acceptable within a slot of a latch 20.

Cross-connect connectors 10 are carried in the above fashion in horizontal mounting positions and are tiered one above another as shown in FIG. 3. Terminals of one row 14*a* are electrically connected to conductor wires 32 of one cable 28 or group of cables and terminals of the other row 14*b* are connected to conductor wires 36 of another cable or group of cables 29. In the finished assembly of the distribution frame 16 and the wiring, incoming groups 32 of insulated conductor wires pass beneath the associated cross-connect connector 10 with ends 34 of wires held within terminals of the terminal row which lies at the back edge of the conductor, i.e. terminals 14*a*. Other conductor wires 36 are connected to terminals of the forward row of terminals 14*b* and these are outgoing conductors connected to other distribution frames, switches or end use terminals as required. Such a system is described in U.S. Pat. No. 4,278,315 to B. T. Osborne, "System for Interconnection of Multiple Insulated Wires", dated 14 July 1981.

Latches 24 are provided vertically between spaced parts 18 of the mounting means, the latches 24 being for receiving a snap-in support member 30 for carrying a designation label for terminals or modular jacks of the connectors.

Figure 5:
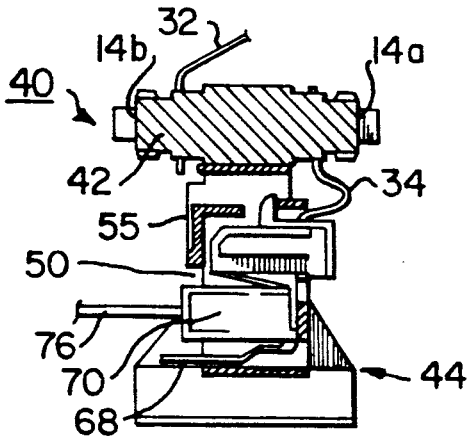
FIG. 5 PRIOR ART
FIG. 5 is an end view of another cross-connect connector of the prior art.

A second type of cross-connect connector 40, shown in FIG. 5, sometimes called a "patch connector", such as that described in U.S. Pat. No. 4,729,124, has an extension 44 of the first body portion 42. The first body portion 42 is similar to the body 12 of the cross-connect connector 12 shown in FIG. 1. The extension 44 carries a row of modular jacks 50 for accepting industry standard telecommunications modular plugs 70. This type of connector takes up two mounting positions in the distribution frame 16 of the type described above, and as illustrated in FIG. 3. Terminals of one row 14*a* are electrically connected to the modular jacks 50 so as to simplify connection of wiring 76 to end use terminals and equipment. Thus modifications and redistribution of connections can easily be made.

Patch connector 40 has a labelling strip 55 on the front facing body portion 46 between the row of insulation displacement terminals 14*b* and the row of modular jacks 50.

Figure 6:
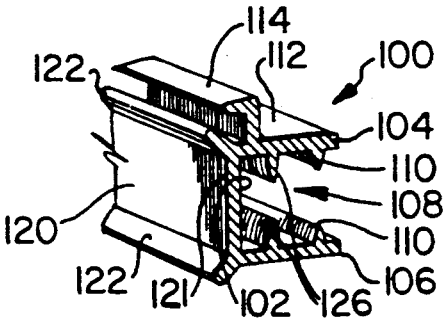
FIG. 6 is an isometric view of a support member for designation cross-connect connectors according to a first embodiment of the present invention.
Figure 7:
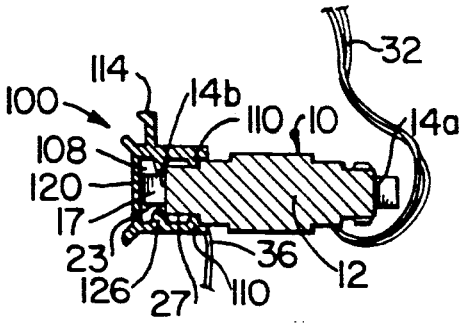
FIG. 7 is a cross sectional view of an assembly of the support member for designation labels according to the first embodiment of the invention and a cross-connect connector.

A support member 100 for a designation label for terminals of a cross-connect connector, according to a first embodiment of the invention, is shown in FIGS. 6 and 7. The support member 100 comprises an elongate body 101 having a first elongate side 102 and laterally extending elongate sidewalls 104 and 106. The side 102 and sidewalls 104 and 106 define a recess 108 receivable over a row of terminals of a cross-connect connector, the recess being open at ends of the support member. The sidewalls 104, 106 provide resilient means in the form of latch structures for retaining the body in attachment with the cross-connect connector, which comprise latch projections 110 of opposing sidewalls 104 and 106. A manually operable latch release means, for releasing the retaining means for removal and installation of the support member is provided on another side of the body 112 remote from the recess. The release means comprises a latch operating extension 114 of one sidewall 104.

The body 101 of the support member 100 is preferably formed from resiliently flexible material so that the latch projections 110 of the sidewalls 104 and 106 are resiliently flexible towards and away from one another. The latch operating extension 114 is operable to move the latch projections 110 resiliently apart from one another and away from a latching position.

Figure 8:
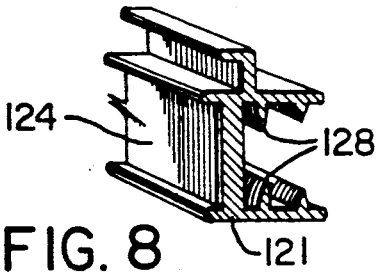
FIG. 8 and 9 are isometric end views of support members for designation labels according to first and second embodiments of the invention showing a label affixed thereto.

The latch projections 110 and the latch operating extension 114 of the sidewalls extend lengthwise along the sidewalls. A label receiving surface 120 is provided on another side 121 of the body facing oppositely away from the one side 102 defining the recess. The surface 120 is elongate, extending lengthwise of the body of the support member for designation labels, and raised edges of the surface define flanges 122 for retaining and easily positioning a label 124 to be adhesively affixed to the surface 120 (FIG. 8).

A support member for a designation label having this construction can simply and economically be made by extrusion moulding from resiliently deformable material, including plastic, for example PVC, in the form of a continuous strip which can be cut to a desired length. Resiliently flexible metal strip moulding also could be used, but since electrical insulation is required, a plastic or other dielectric coating would be needed. Alternatively individual support members for designation labels may be produced by injection moulding of plastic.

In use of the support member of the first embodiment and as shown in the assembly of support member for designation labels with a cross-connect connector (FIG. 7) the recess 108 is received over a row of insulation displacement terminals **14*b* of a cross-connect connector 10 The opposing latch projections 110 engage grooves 27 in opposite sides 25 of the body 12 of the cross-connect connector. Abutment surfaces 128 of protrusions 126 extend into the recess 108 along each sidewall 104, 106 and are spaced from the latch projections 110. The surfaces 128 engage surfaces 23 of the body 12 of the connector 10 to locate the support member on the connector so that the latch projections 110 are received into a latch receiving groove 27**.

During installation of the support member 100 over terminals **14*b* of a connector, the sidewalls 104 and 106 of the support member 100 are resiliently flexed apart as the latch projections 110 pass over the surfaces 25 of the body 12, and they resiliently return to their latching positions when the latch projections 110 engage into the latch receiving grooves 27. The support member 100 is held securely in place with the latch projections resiliently engaging the connector body and with the labelling surface 120** facing away from the connector.

For removal of the support member from a connector body, manually applied force on the latch operating extension 114 in a direction away from the connector causes the sidewall 104 to flex away from the connector 10 so that the latch projections 110 are moved apart from one another and are brought clear of the latch receiving grooves 27 so that the support member may be pulled away from the connector body and removed.

In use of the support member as part of an assembly with a cross-connect connector, besides providing a labelling surface 120, the support member may act as a strain relief for wire conductors received in terminals **14*b* of the cross-connect connector with the latch extensions 110 engaging and covering ends of the wire conductors, and preventing accidental removal or dislodgement of wire conductors during maintenance or installation work on neighbouring connectors. The strain relief is provided, at least in part, by engagement between the abutment surfaces 128 and the wire conductors. Furthermore, use of support members 100 with cross-connect connectors 10 such as illustrated in FIG. 1 may provide finger protection to an installer by covering the sharp teeth-like projections 17 between terminals 14*a* and 14*b* of the connector 10**.

Figure 9:
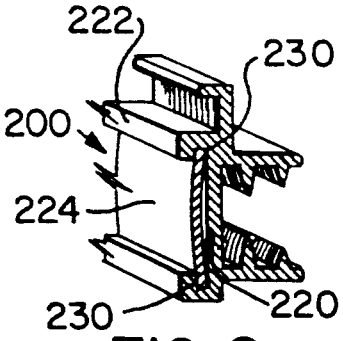

In a support member 200 for a designation label for a cross-connect connector, according to a second embodiment, and as shown in FIG. 9, the support member is similar to that of the first embodiment shown in FIGS. 6 to 8, except that flanges 222 at edges of the surface 220 are formed with label receiving grooves 230 extending along each edge of the elongate surface 220 for slidably receiving and retaining a label or labels.

Figure 10:
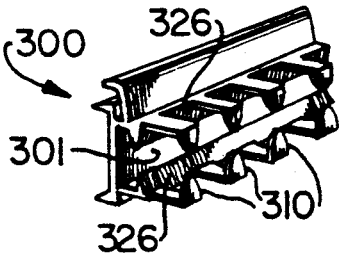
FIG. 10 is an isometric end view, in a different direction from 8 and 9, of a support member for designation labels to a third embodiment of the invention.

In a support member 300 for a designation label according to a third embodiment of the invention, the retaining means comprise a plurality of latch structures 310 extending from a body 301 of the support member (FIG. 10).

Figure 11:
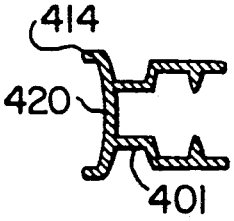
FIG. 11 is a cross sectional view of a support member for designation labels according to a fourth embodiment of the invention.

In a support member 400 according to a fourth embodiment (FIG. 11) of the invention, a latch operating extension 414 is formed as a lateral part of a body 401 which provides the labelling surface 420.

In other embodiments of support members for designation labels, the orientation of the labelling surface is angled so that a designation label is more easily readable when the support member is mounted on a connector in a distribution frame.

What is claimed is:

1. An assembly of a support member for a designation label for terminals of a cross-connect connector and a cross-connect connector, comprising:

a cross-connect connector having an elongate connector body, and a support member having an elongate support member body providing on one side laterally extending elongate opposing sidewalls, said one side of the support member body and the elongate opposing sidewalls defining a recess which is received over a row of terminals of the cross-connect connector, the support member shrouding the terminals and the recess being open at ends of the support member, the sidewalls being resiliently movable away from one another and providing latch projections extending lengthwise along the support member body and engaging in corresponding latch receiving grooves of the connector body to retain the support member in attachment with the connector body, and the sidewalls of the support member body providing abutment surfaces which engage surfaces of the connector body so as to align the latch projections of the support member in the corresponding latch receiving grooves during installation of the support member; and manually operable means comprising an extension of the support member body, on a side of the body remote from the recess, operable to cause movement of the latch projections resiliently apart and away from the sides of the connector body for removal and installation of the support member;

the support member body providing on another side, facing away from the connector, an elongated surface for receiving a designation label for the connector.

2. An assembly according to claim 1 wherein each latch projection comprises a rib extending along each sidewall, and each rib engages a corresponding latch receiving groove extending along a side of the connector body, and the manually operable means comprises a latch operating extension extending lengthwise of the support member body.

3. An assembly according to claim 1 wherein wires are received into insulation displacement terminals of the cross-connect connector and the abutment surfaces of the support member engage and provide strain relief for wires received in the insulation displacement terminals.

4. A support member for a designation label for terminals of across-connect connector, comprising:

an elongate body having on one side laterally extending elongate opposing sidewalls, said one side of the body and the sidewalls defining an elongated recess for receiving a row of terminals of a cross-connect connector, the recess being open at ends of the support member, the sidewalls being resiliently movable away from one another and providing means for retaining the body in attachment with the cross-connect connector, the retaining means comprising an elongate latch projection of each side wall extending into the recess along the length of the body, and the sidewalls providing abutment surfaces spaced from the latch projections and extending into the recess for engaging surfaces of the connector whereby during installation of the support member the latch projections are aligned in latch receiving grooves of the connector; and manually operable release means comprising an extension of the body, on a side of the body remote from the recess and operable to cause movement of the latch projections resiliently apart from one another and away from a latching position for removal from and installation of the support member upon a cross-connect connector;

the body providing on another side an elongate surface for receiving a designation label.

5. A support member for a designation label for terminals of a cross-connect connector, comprising:

an elongate body having on one side laterally extending elongate opposing sidewalls, said one side of the body and the opposing sidewalls defining an elongated recess for receiving a row of terminals of a cross-connect connector, the recess being open at ends of the support member, the sidewalls being resiliently movable away from one another and providing means for retaining the body in attachment with the cross-connect connector, the retaining means comprising a series of latch projections extending lengthwise of the body along opposing sidewalls, and the sidewalls providing abutment surfaces spaced from the latch projections and extending into the recess for engaging surfaces of the connector whereby during installation of the support member the latch projections are aligned in latch receiving grooves of the connector; and manually operable release means comprising a latch operating extension of the body, on a side of the body remote from the recess and operable to cause movement of the latch projections resiliently apart from one another and away from a latching position for removal from and installation of the support member upon a cross-connect connector; and, the body providing on another side an elongate surface for receiving a designation label.

6. A support member for a designation label for terminals of a cross-connect connector comprising:

an elongate support member body providing on one side laterally extending elongate opposing sidewalls, said one side of the support member body and the opposing sidewalls defining a recess for receiving a row of terminals of the cross-connect connector, the recess being open at ends of the support member, the sidewalls being resiliently movable away from one another and providing latch projections for retaining the support member body in attachment with the connector body, said latch projections extending lengthwise along the support member body for engaging latch receiving grooves along sides of the connector body, and the sidewalls of the support member body providing abutment surfaces for engaging surfaces of the connector body whereby the latch projections of the support member are aligned with corresponding latch receiving grooves of the connector body during installation of the support member; and manually operable means comprising an extension of the support member body, on a side of the body remote from the recess, operable to cause movement of the latch projections resiliently apart and away from a latching position for removal and installation of the support member;

the support member body providing on another side, facing away from the connector, an elongated surface for receiving a designation label for the connector.

7. A support member according to claim 6 wherein each latch projection is elongate and extends into the recess along the length of the body.

8. A support member according to claim 6 wherein the elongate surface for receiving a designation label is on a side of the body opposite the one side defining the recess.

9. A support member for designation labels according to claim 6 wherein a label is adhesively affixed to the elongate surface.

10. A support member according to claim 6 wherein the lateral extension is elongate and extends lengthwise of the body on a side of the body remote from the recess.

11. A support member according to claim 10 wherein the support member is formed by extrusion moulding.

12. A support member according to claim 6 wherein the elongate surface comprises label retaining means.

13. A support member according to claim 12 wherein the label retaining means comprises a flange extending lengthwise along each of two elongate edges of the elongate surface and each flange defines a label receiving groove extending lengthwise along each of two edges of the elongate surface for slideably receiving and retaining edges of a label.

* * * * *